US006127613A

United States Patent [19]

Hansel

[11] Patent Number: 6,127,613

[45] Date of Patent: Oct. 3, 2000

[54] PICK FOR A STRINGED INSTRUMENT

[76] Inventor: Douglas D. Hansel, 6102 Blue Hen Pl., Westerville, Ohio 43081

[21] Appl. No.: 09/440,427

[22] Filed: Nov. 15, 1999

Related U.S. Application Data

[60] Provisional application No. 60/110,157, Nov. 27, 1998.

[51] Int. Cl.[7] ..... G10D 3/16

[52] U.S. Cl. ..... 84/332; 84/320; 84/321

[58] Field of Search ..... 84/322, 320, 321, 84/315

[56] References Cited

U.S. PATENT DOCUMENTS

| | | | |
|---|---|---|---|
| D. 392,668 | 3/1998 | Shingler | D17/20 |
| 3,699,838 | 10/1972 | Montgomery | 84/322 |
| 3,735,663 | 5/1973 | Cowell, Sr. | 84/322 |
| 4,020,732 | 5/1977 | Kelly | 84/322 |
| 4,270,433 | 6/1981 | Adamec | 84/322 |
| 5,973,243 | 10/1999 | Christenson | 84/322 |

*Primary Examiner*—David Martin
*Assistant Examiner*—Kim Lockett
*Attorney, Agent, or Firm*—Thomas S. Baker Jr.

[57] ABSTRACT

A pick assembly for use in plucking or strumming the strings of a stringed musical instrument is provided with a relatively inflexible plectrum element and a relatively flexible and short molded tether body element bonded at one end to the plectrum element and having a finger loop at the other end. A preferred tether body element cross-section, in combination with friction engagement of the pick assembly with the user's forefinger, significantly restricts rotation of the assembly about the axis of the user's forefinger.

12 Claims, 1 Drawing Sheet

PICK FOR A STRINGED INSTRUMENT

This application is based upon Provisional application Ser. No. 60/110,157 filed Nov. 27, 1998.

FIELD OF THE INVENTION

This invention relates generally to musical instruments, and particularly concerns a pick assembly that may be utilized advantageously for manually plucking or strumming the strings of a stringed musical instrument such as a banjo, mandolin, or guitar.

BACKGROUND OF THE INVENTION

A stringed musical instrument pick, sometimes also referred to as a stringed musical instrument plectrum, has typically and by traditional design, been a very small and thin, relatively stiff, one-piece device held or grasped by the utilizing musician between thumb and forefinger. In order to retain the pick in proper place when held, the string resistance forces encountered by the pick must be overcome by the pinching forces of the musician's grasp of the pick. If the pinching force is less, the pick device will either twist between the utilizing musician's fingers, allowing the pick to position itself in an uncomfortable or even unusable position, or the pick device may be altogether dropped.

To overcome the use shortcomings of the traditional stringed instrument pick device, I have discovered a novel pick and tether combination that may be advantageously utilized by a musician for plucking or strumming the strings of a stringed musical instrument such as a banjo, mandolin, or guitar.

Other advantages and objectives of the present invention will become apparent during consideration of the detailed descriptions, drawings, and claims which follow.

SUMMARY OF THE INVENTION

The present invention is basically an assembly comprised of a planar plectrum element in combination with a tether body element joined to the plectrum element. The invention plectrum element is of conventional size and material of construction, is relatively inflexible, and is provided with an integrally-molded bonding bore. The joined tether element preferably is made of a flexible elastomer material, is bonded to the plectrum element at the plectrum bonding bore and adjacent under-surface, and has an integral finger loop at its end opposite the end attached to the plectrum element.

The elastomer tether element also is preferably provided with grip ridges and/or grip depressions integrally molded in the tether element opposite faces in the region of the pick element integral bonding bore.

BRIEF DESCRIPTION OF THE DRAWINGS

FIG. 1 is a perspective view of the stringed instrument pick of the present invention held in the hand of a musician in position for use in plucking or strumming the strings of a stringed musical instrument such as a banjo, mandolin, guitar, or the like.

DETAILED DESCRIPTION

Figure 1:
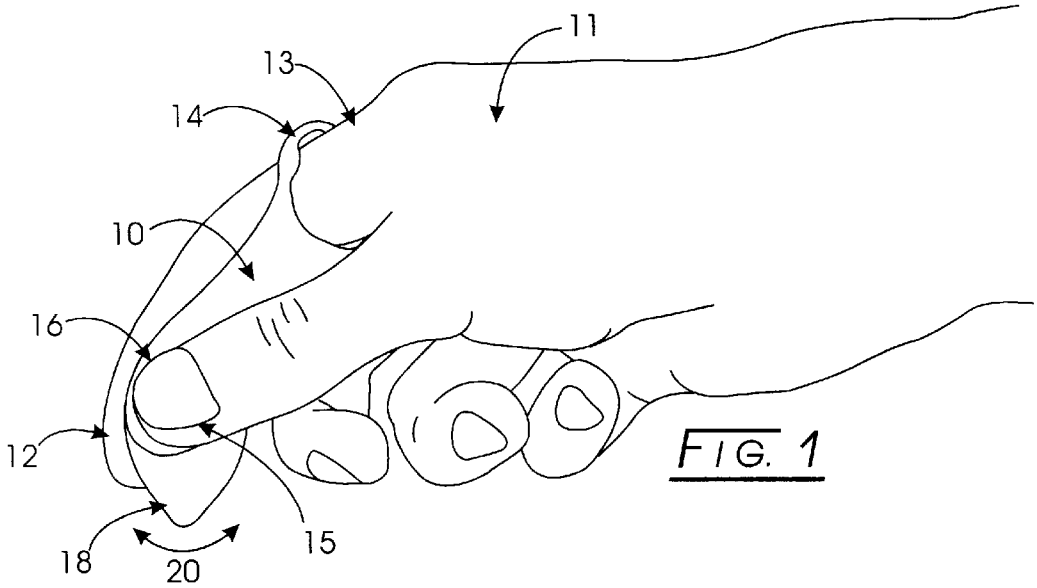
Figure 2:
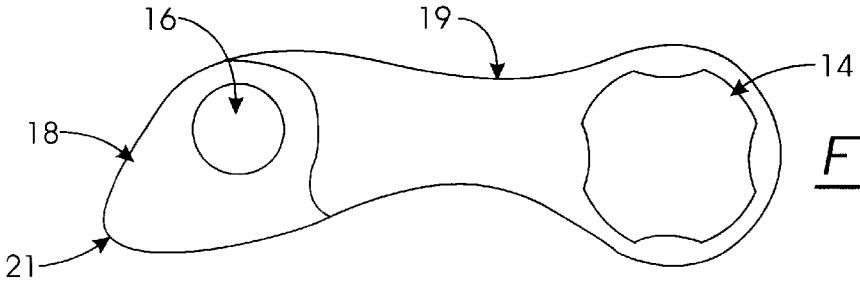
FIG. 2 is a top plan view of the stringed instrument pick invention.
Figure 3:
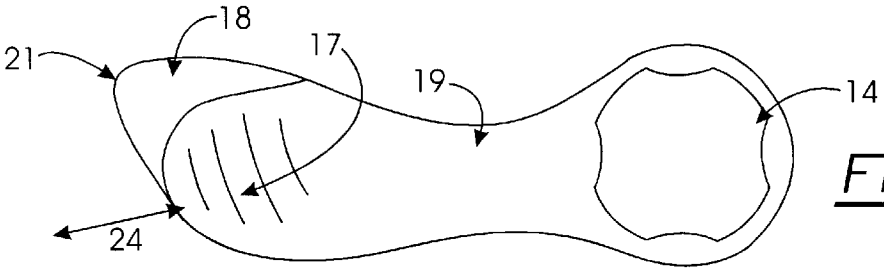
FIG. 3 is a bottom plan view of the stringed instrument pick invention.

Referring to FIG. 1, the illustrated preferred embodiment of the stringed instrument pick assembly of the present invention is designated as 10 and is shown grasped in a musician's hand 11 between thumb 15 and forefinger 12 and positioned for plucking or strumming the strings of a conventional stringed musical instrument such as a banjo, mandolin, guitar, or the like. Assembly 10 is basically comprised of a relatively flexible tether element 19 and a relatively inflexible pick element 18 bonded to and carried by the tether element.

Inflexible pick element 18 is preferably made of a fiber-reinforced moldable polymer resin such as polypropylene resin, nylon resin, etc., and also preferably includes an integral bond bore 23 (see FIG. 4) extending through the pick element thickness. Flexible tether element 19 is preferably made of a moldable elastomer such as Santoprene™ copolymer, and also includes an molded integral tether loop 14 through which the musician's forefinger 12 is normally inserted as far as establishing friction contact with finger knuckle region 13 for proper non-rotating retention of the tether loop on the forefinger. Also, I recommend that the particular elastomer utilized for tether element 19 have a cured Shore Durometer "A" resiliency value in the range from 35 to 55, and that the resiliency value preferably be about Shore "A" 45.

Additionally, it should be noted that the under-surface of tether body element 19 functions as a gripping surface and is provided with integrally-molded grip ridges 17 positioned generally opposite to the integrally-molded inset boss 16 that is formed in bond bore. Alternatively, relatively shallow grip depressions may be substituted for grip ridges. Such grip ridges/depressions are normally formed during the injection molding of the selected tether body 19 elastomer in an injection mold cavity having the plectrum element as a mold insert. Also, I prefer that the face of molded boss 16 be provided with integrally-molded grip ridges/depressions although such are not shown in the drawings.

Figure 4:
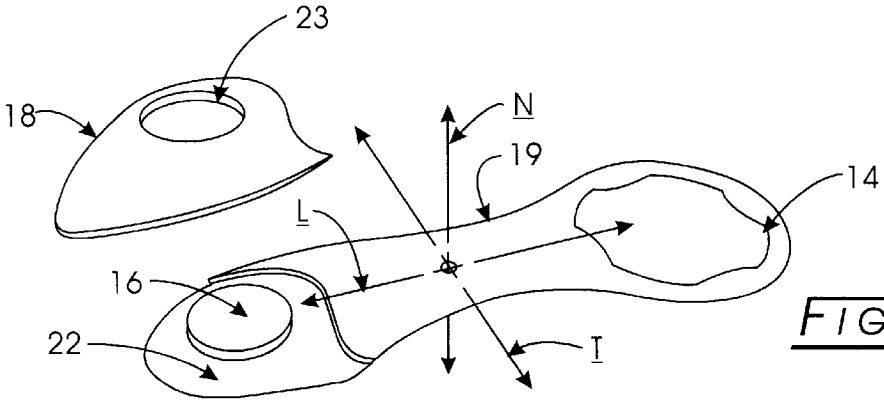
FIG. 4 is an exploded view of the stringed instrument pick invention.

FIG. 4 illustrates orthogonal co-ordinate axes which pass through the center of gravity of pick assembly 10, such being referred to as a longitudinal axis L, a transverse axis T, and a normal axis N. The physical configuration of tether element 19 is such that the element cross-section moment of inertia about transverse axis T is substantially less than the element cross-section moment of inertia about normal axis N. Thus, if the user of pick assembly 10 releases the pinching grip between thumb 15 and forefinger 12, flexible tether body element 19 is freed of restraint such that it may readily bend into or from the plane of axes L and T but bend very little, if at all, in that plane. Arrow notation 20 of FIG. 1 illustrates the directions of restricted free rotation of pick assembly 10 relative to forefinger 12.

The drawings illustrate a tether body forefinger loop 14 having internal protuberances that are instrumental in developing frictional contact between such loop and an inserted forefinger. I have also provided some embodiments of assembly 10 with a forefinger loop portion 14 not having internal protuberances, and instead have made such assemblies available in sizes with different loop diameters.

Changes in structure, materials, sizes, and shapes described herein may be made without departing from the scope, meaning, or intent of the claims.

I claim, as my invention:

1. A pick assembly for plucking or strumming the strings of a stringed musical instrument, and comprising:

an inflexible plectrum element; and a flexible molded tether element joined at one of its ends to said plectrum element and having an integral finger loop at the tether end distant from said plectrum element, said plectrum element being joined to said flexible tether element in a fixed position.

2. The pick assembly invention defined by claim 1, and wherein a portion of said flexible molded tether element overlies and is bonded to a surface of said inflexible plectrum element and has an under-surface area that functions as a base gripping surface.

3. The pick assembly invention defined by claim 2, wherein said inflexible plectrum element is provided with a bonding bore extending through the plectrum element thickness, said flexible molded tether element extending through said bonding bore to form an insert gripping surface opposite said flexible molded tether element under-surface area base gripping surface.

4. The pick assembly invention defined by claim 1, and wherein said inflexible plectrum element and said flexible molded tether element are formed of polypropylene polymer resin, said plectrum and molded tether elements being joined by a chemical bond formed during the molding of said flexible molded tether element.

5. The pick assembly invention defined by claim 2, and wherein said flexible molded tether element under-surface area base gripping surface is provided with integrally-molded elongated grip ridges.

6. The pick assembly invention defined by claim 3, and wherein said flexible molded tether element insert gripping surface is provided with integrally-molded grip ridges.

7. The pick assembly invention defined by claim 5, and wherein said integrally-molded elongated grip ridges are oriented substantially transverse to the longitudinal axis of said flexible molded tether element.

8. The pick assembly invention defined by claim 6, and wherein said integrally-molded grip ridges are oriented substantially transverse to the longitudinal axis of said flexible molded tether element.

9. The pick assembly invention defined by claim 1, and wherein said flexible molded tether element is formed of an elastomer composition having a Shore "A" Durometer value in the range of approximately from 35 to 55.

10. The pick assembly invention defined by claim 9, and wherein said flexible molded tether element is formed of an elastomer composition having a Shore "A" Durometer value of approximately 45.

11. The pick assembly invention defined by claim 1, and wherein said flexible molded tether element has a configuration at the assembly center of gravity for which the cross-section moment of inertia about the tether element transverse co-ordinate axis is significantly less than the configuration cross-section moment of inertia about the tether element normal co-ordinate axis.

12. A pick assembly for plucking or strumming the strings of a stringed musical instrument, and comprising:

an inflexible plectrum element;

a flexible molded tether element joined at one of its ends to said plectrum element and having an integral finger loop at the tether end distant from said plectrum element, said plectrum element being joined to said flexible tether element in a fixed position; and wherein said flexible element may bend in a transverse axis.

* * * * *